United States Patent [19]

Sasaki et al.

[11] Patent Number: 4,933,316

[45] Date of Patent: Jun. 12, 1990

[54] INK IMAGE RECEIVING SHEET USABLE IN THERMAL INK TRANSFER RECORDING

[75] Inventors: Keiji Sasaki, Tokyo; Katsumi Moronuki, Koganei, both of Japan

[73] Assignee: Honshu Paper Co., Ltd., Tokyo, Japan

[21] Appl. No.: 373,087

[22] Filed: Jun. 28, 1989

[30] Foreign Application Priority Data

Jun. 29, 1988 [JP] Japan ..... 63-161459

[51] Int. Cl.[5] ..... B41M 5/26

[52] U.S. Cl. ..... 503/227; 8/471; 428/195; 428/141; 428/211; 428/408

[58] Field of Search ..... 8/471; 428/195, 141, 428/211, 408, 913, 914; 503/227

[56] References Cited

FOREIGN PATENT DOCUMENTS 0137790 6/1986 Japan ..... 503/227

*Primary Examiner*—Bruce H. Hess

*Attorney, Agent, or Firm*—Seed and Berry

[57] ABSTRACT

The present invention relates to an ink image receiving sheet usable in thermal ink-transfer recording. The sheet has a surface roughness index determined by Bristow method (Vr) (using linseed oil under pressure of 0.1 MPa) being 5 to 10 ml/m$^2$. According to the present invention, the image resolution of the sheet having a transferred ink image is excellent and the ink transfer efficiency during the transfer recording is improved.

4 Claims, No Drawings

INK IMAGE RECEIVING SHEET USABLE IN THERMAL INK TRANSFER RECORDING

BACKGROUND OF THE INVENTION

1. Field of the Invention

The present invention relates to an ink image receiving sheet usable in thermal ink-transfer recording which is to be used in such a manner that a thermal ink-transfer recording medium (ink donor sheet) comprising a heat-meltable or heat-sublimable ink coated on one side of a support made of a paper, a plastic film or the like is laminated on the ink image receiving sheet and the recording medium is selectively heated according to image information to transfer the ink, which is molten or sublimed by heat, onto the ink image receiving sheet, thereby recording the image information.

2. Prior Art

It has been thought that no special sheets are necessary for the heat transfer recording and that ordinal plain papers for printing are sufficient for this purpose. Under these circumstances, those skilled in the art have been scarcely interested in such sheets.

However, as the recording speed of the heat transfer recording system is increased, the image resolution and ink-transfer efficiency are reduced disadvantageously. To overcome these defects, processes for improving the ink donor sheets and for improving the apparatus have been proposed For example, for preventing the reduction of the image resolution or ink-transfer efficiency, a process wherein an inorganic pigment having a high oil absorption is incorporated in the ink image receiving sheet [see Japanese Patent Unexamined Published Application (hereinafter referred to as 'J. P. KOKAI') No.63-19289] and a process wherein a porous coating layer having a high oil absorption is formed on the ink image receiving sheet (see J. P. KOKAI No.62-160286) were proposed.

However, even by these processes, a sufficient image resolution or ink-transfer efficiency cannot be always obtained.

SUMMARY OF THE INVENTION

An object of the present invention is to provide an ink image receiving sheet for the heat transfer recording, which sheet has an excellent ink-transfer efficiency and an excellent image resolution even at a high recording speed.

After intensive investigations made for the purpose of attaining the above-described object, the inventors have found out that the ink-transfer efficiency and the image resolution vary depending on the behavior of the ink image receiving sheet in absorbing the molten or sublimed ink in a short time (the order of several millisecond (ms) or less). In particular, unless the ink transferred onto the surface of the ink image receiving sheet is absorbed by the sheet within a period of time as short as several ms or less, the ink transfer efficiency and the image resolution are impaired and, therefore, no satisfactory record can be obtained.

After further investigations of the absorption behavior of the sheet in such a short period of time, the inventors have found out that the absorption coefficient (Ka) determined by Bristow method has no relation with the ink transfer efficiency or image resolution but the absorption rate is largely related thereto.

Having employed the roughness index (Vr) determined by Bristow method [according to J. TAPPI Paper pulp test method Nos.51 to 87; J. A. Bristow, Svenska Papperstidn. 70 (19) 623 (1967)] for evaluating the absorption rate, the present inventors have found out that when the roughness index is 5 to 10 ml/m$^2$, the resulting heat transfer record is excellent in ink-transfer efficiency and image resolution. The present invention has been completed on the basis of this finding. The roughness index has not been used for evaluating the oil absorption rate in a short period of time until the present invention is made.

Namely, the present invention relates to an ink image receiving sheet for the thermal ink-transfer recording, the surface of said sheet having a roughness index determined by Bristow method (Vr) (with linseed oil under pressure of 0.1 MPa) of 5 to 10 ml/m$^2$.

DETAILED DESCRIPTION OF THE INVENTION

The sheet of the present invention comprises either a support containing an inorganic pigment or a support having a coated film containing an inorganic pigment and a binder. The inorganic pigments usable in the present invention include, for example, silica, calcium carbonate, calcined clay, aluminum oxide, titanium oxide, magnesium carbonate, diatomaceous earth, anhydrous silicic acid, silicic acid hydrate, aluminum silicate, magnesium silicate, calcium silicate, sodium aluminosilicate, magnesium aluminosilicate, barium sulfate and aluminum hydroxide.

The binders include, for example, casein, starch, PVA, methyl cellulose, carboxymethyl cellulose, hydroxyethyl cellulose, water-soluble resins such as polyacrylic acid and latexes such as SBR and MBR.

The support is mainly a paper and further a synthetic paper or a plastic film is also usable.

The sheet of the present invention having the above-described structure can further contain various additives which impart desired characteristics to the sheet. For example, the sheet containing the inorganic pigment may further contain a neutral sizing agent and the sheet having the coated film may contain a dispersing agent and an antifoaming agent.

The amount of the inorganic pigment is usually at least 10 wt. % based on the support in respect of the inorganic pigment-containing sheet and it is usually 1 to 15 g/m$^2$ in respect of the sheet having the coated film.

The amount of the inorganic pigment to be used is determined by taking into consideration the toughness of the sheet and the roughness index (Vr) which will be described below.

The oil-absorption rate of the present sheet is determined by Bristow method (J. TAPPI, Paper pulp test method Nos.51 to 87) using linseed oil under pressure of 0.1 MPa and it is evaluated in terms of the roughness index (Vr) determined by Bristow method. The sheet of the present invention must have a Vr of 5 to 10 ml/m$^2$. When the roughness index is beyond this range, the ink transfer efficiency and the image resolution are seriously reduced. Vr is preferably in the range of 6 to 9 ml/m$^2$.

The image resolution can be further increased by increasing the smoothness of the receiving sheet. The smoothness can be suitably controlled by varying the kind and amount of the pigment and/or calendering the sheet.

The following examples will further illustrate the present invention.

EXAMPLE 1

20 parts by weight of silicic acid hydrate (Siloid 244; a product of Fuji Davison Co.) having an oil absorption of 300 ml/100g, 0.3 part by weight of a neutral sizing agent (Hercon W; a product of Die-Hercules Chemicals, Inc.), 3 parts by weight of a cationizd starch (a product of Sanwa Denpun Co.) and 0.2 part by weight of an anionic polyacrylic amide (Polystron 117; a product of Arakawa Kagaku Co.) were added to a pulp slurry comprising 50 parts by weight of LBKP having a Canadian Standard Freeness (C.S.F.) of 300 ml and 50 parts by weight of NBKP having a C.S.F. of 300 ml, to make a paper having a basis weight of 60 g/m$^2$. It was then calendered to obtain a sheet having a thickness of 70 $\mu$m, a surface smoothness of 700 sec, a degree of sizing of 5 sec and a pigment content of 15 wt. %.

EXAMPLE 2

A sheet was prepared in the same manner as that of Example 1 except that 40 parts by weight of calcium carbonate (PC; a product of Shiraishi Kogyo Co.) having an oil absorption of 45 ml/100 g was used as the pigment.

EXAMPLE 3

A coating solution having the following composition (total solid content: 40%) was applied to an original paper (basis weight: 52 g/m$^2$) in an amount of 10 g/m$^2$ with a Meyer bar:

| | |
|---|---|
| Silica (P-527; a product of Mizusawa Kagaku Co. having an oil absorption of 160 ml/100 g) | 100 parts by weight |
| 25% Aqueous solution of water-soluble polyester resin (a product of Goo Kagaku Co.) | 40 parts by weight |
| 10% Aqueous solution of casein (a product of Nissei Kyoeki) | 100 parts by weight |
| Calcium stearate | 2 parts by weight |
| Water | 63 parts by weight |
| Total | 305 parts by weight |

After calendering, a sheet having a surface smoothness of 1,000 sec was formed.

EXAMPLE 4

A sheet was prepared in the same manner as that of Example 3 except that a coating solution having the following composition (total solid content: 50%) was applied to an original paper (basis weight: 52 g/m$^2$) in an amount of 10 g/m$^2$ with Meyer bar:

| | |
|---|---|
| Calcined clay (Ansilex 90; a product of Engelhard Co. having an oil absorption of 80 ml/g) | 100 parts by weight |
| 10% Aqueous solution of casein (a product of Nissei Kyoeki) | 50 parts by weight |
| Dispersant (Toagosei Aron 30 SL) | 1 part by weight |
| Water | 62 parts by weight |
| Total | 213 parts by weight |

EXAMPLE 5

A sheet was prepared in the same manner as that of Example 3 except that a coating solution having the following composition (total solid content: 45%) was applied to an original paper (basis weight: 52 g/m$^2$) in an amount of 10 g/m$^2$ with a Meyer bar:

| | |
|---|---|
| Aluminum hydroxide (Higilite H-42; a product of Showa Denko K.K. having an oil absorption of 45 ml/100 g) | 100 parts by weight |
| 48% Solution of SBR latex (Asahi Kasei L-1924) | 20 parts by weight |
| 10% Aqueous solution of casein (a product of Nissei Kyoeki) | 30 parts by weight |
| Calcium stearate | 2 parts by weight |
| Water | 68 parts by weight |
| Total | 220 parts by weight |

EXAMPLE 6

Example 1 was repeated except that the calendering condition was changed, to produce a sheet having a surface smoothness of 1500 sec.

COMPARATIVE EXAMPLE 1

A sheet was prepared in the same manner as that of Example 1 except that silicic acid hydrate (Siloid 244 of Fuji Davison Co.) was not used.

COMPARATIVE EXAMPLE 2

A sheet was prepared in the same manner as that of Example 3 except that a coating solution having the following composition (total solid content: 35%) was applied to a paper (basis weight: 52 g/m$^2$) in an amount of 10 g/m$^2$ with a Meyer bar:

| | |
|---|---|
| Silica (P-527; a product of Mizusawa Kagaku Co. having an oil absorption of 160 ml/100 g) | 100 parts by weight |
| 25% Aqueous solution of water-soluble polyester resin (a product of Goo Kagaku Co.) | 60 parts by weight |
| 10% Aqueous solution of casein (a product of Nissei Kyoeki) | 100 parts by weight |
| Calcium stearate | 2 parts by weight |
| Water | 101 parts by weight |
| Total | 363 parts by weight |

COMPARATIVE EXAMPLE 3

A sheet was prepared in the same manner as that of Example 3 except that the calendering was conducted to obtain a surface smoothness of 400 sec after the coating was made in an amount of 10 g/m$^2$.

COMPARATIVE EXAMPLE 4

A sheet was prepared in the same manner as that of Example 1 except that the calendering condition was changed to obtain a surface smoothness of 600 sec.

COMPARATIVE EXAMPLE 5

A sheet was prepared in the same manner as that of Example 1 except that the calendering condition was changed to obtain a surface smoothness of 2000 sec.

COMPARATIVE EXAMPLE 6

A sheet was prepared in the same manner as that of Example 3 except that the calendering condition was changed to obtain a surface smoothness of 2400 sec.

The sheets prepared in Examples 1 to 6 and Comparative Examples 1 to 6 were used for recording with a word processor WD-800 (a product of Sharp Corporation) and donor sheets (products of Fuji Kagakushi Co.). The image resolution and image density (transfer efficiency) of the products were evaluated. The results are shown in Table 1 below.

The roughness index (Vr) was determined from a linseed oil absorption curve by Bristow method (J. TAPPI Nos.51 to87) under pressure of 0.1 MPa.

TABLE 1

| | Roughness index Vr ($ml/m^2$) | Bekk smoothness | Image resolution*1 | Image density*2 (transfer efficiency) |
|---|---|---|---|---|
| Example 1 | 7 | 700 | ◎ | 1.76 |
| Example 2 | 5 | 700 | ○ | 1.69 |
| Example 3 | 9 | 1000 | ◎ | 1.84 |
| Example 4 | 7 | 1000 | ◎ | 1.73 |
| Example 5 | 6 | 1000 | ○ | 1.70 |
| Example 6 | 6 | 1500 | ○ | 1.71 |
| Comp. Ex. 1 | 3 | 700 | X | 1.15 |
| Comp. Ex. 2 | 4 | 700 | Δ | 1.47 |
| Comp. Ex. 3 | 14 | 400 | X | 1.40 |
| Comp. Ex. 4 | 11 | 500 | Δ | 1.42 |
| Comp. Ex. 5 | 4 | 2000 | ◎ | 1.32 |

TABLE 1-continued

| | Roughness index Vr ($ml/m^2$) | Bekk smoothness | Image resolution*b | Image density*2 (transfer efficiency) |
|---|---|---|---|---|
| Comp. Ex. 6 | 3.5 | 2400 | ◎ | 1.34 |

*1Image resolution: A photograph of a 1-dot print was taken and macroscopically evaluated.◎: very good, ○: good, Δ: poor, X: very poor

*2Image density (transfer efficiency): The image density of the all mark was determined with a Macbeth densitometer RD-514 and a visual filter. The higher the image density, the higher the transfer efficiency.

It is apparent from Table 1 that when the roughness index (Vr) of the ink image receiving sheet of the present invention is in the range of 5 to 10 $ml/m^2$, an excellent image resolution and a high transfer efficiency can be obtained. According to the present invention, the ink donor sheets per se can be used without any modification in the heat ink-transfer recording process. The invention is, therefore, costly advantageous.

WHAT IS CLAIMED IS

1. An ink image receiving sheet for thermal ink-transfer recording characterized in that the surface of said sheet has a roughness index determined by Bristow method (Vr) (using linseed oil under pressure of 0.1 MPa) being 5 to 10 $ml/m^2$.

2. The sheet of claim 1 which has a Vr of 6 to 9 $ml/m^2$.

3. The sheet of claim 1 which contains an inorganic pigment in a support or which has a coated film containing a pigment on said support.

4. The sheet of claim 1 which comprises a paper, a synthetic paper or a plastic as a support.

* * * * *